US005323835A

United States Patent [19]

Bachmeier

[11] Patent Number: 5,323,835

[45] Date of Patent: Jun. 28, 1994

[54] REMOVABLE SCREEN FOR A CAR GARAGE DOOR

[76] Inventor: Steven J. Bachmeier, 309 Burke Ave., Harvey, N. Dak. 58341

[21] Appl. No.: 142,182

[22] Filed: Oct. 26, 1993

Related U.S. Application Data

[63] Continuation-in-part of Ser. No. 824,070, Jan. 23, 1992, abandoned, which is a continuation of Ser. No. 561,887, Aug. 2, 1990, abandoned, which is a continuation of Ser. No. 411,558, Sep. 22, 1989, abandoned.

[51] Int. Cl.[5] ..... A47H 1/00

[52] U.S. Cl. ..... 160/89; 160/354; 160/368.1

[58] Field of Search ..... 160/368.1, 354, 323, 160/201, 209, 89, 90, 105, 106

[56] References Cited

U.S. PATENT DOCUMENTS

| | | | |
|---|---|---|---|
| 550,652 | 12/1895 | Spaulding . | |
| 2,297,729 | 10/1942 | Thomas | 160/238 |
| 2,771,945 | 6/1953 | Wittrup | 160/124 |
| 3,455,366 | 9/1966 | Bogumil | 160/368 |
| 3,464,480 | 9/1969 | Kuss | 160/368 |
| 3,848,653 | 11/1974 | Youngs | 160/120 |
| 3,856,072 | 12/1974 | Sund | 160/84 R |
| 4,100,957 | 7/1978 | Shelton | 160/368 R |
| 4,249,589 | 2/1981 | Loeb | 160/368 R |
| 4,909,004 | 3/1990 | Panttila | 160/327 X |

FOREIGN PATENT DOCUMENTS

| | | |
|---|---|---|
| 715355 | 8/1965 | Canada . |
| 2089412 | of 0000 | United Kingdom . |
| 2134166 | of 0000 | United Kingdom . |

*Primary Examiner*—Blair M. Johnson
*Attorney, Agent, or Firm*—Zarley, McKee, Thomte, Voorhees & Sease

[57] ABSTRACT

A screen is provided for a garage door and has the same dimensions as the garage door. A Velcro® fastening system is utilized to secure the top and opposite side edges of the flexible screen means to the interior door casing so that the screen will be positively maintained in place to prevent the passage of insects, leaves, etc. into the garage. A vertically disposed double zipper is provided in the screen to permit access into the interior of the garage or exit therefrom.

1 Claim, 3 Drawing Sheets

REMOVABLE SCREEN FOR A CAR GARAGE DOOR

CROSS-REFERENCE TO RELATED APPLICATION

This is a continuation-in-part of co-pending Ser. No. 07/824,070, filed on Jan. 23, 1992, now abandoned, which is a continuation of Ser. No. 07/561,887 filed on Aug. 2, 1990, now abandoned, which is a continuation of Ser. No. 07/411,558 filed on Sep. 22, 1989, now abandoned.

BACKGROUND OF THE INVENTION

This invention relates to a screen and more particularly to a flexible screen which may be quickly and easily positioned in a car garage door opening to prevent insects, leaves, etc. from entering the garage when the garage door is open or partially open.

The door of a car garage is frequently left open which permits insects, leaves, etc. to enter the same. There are many times when it is desirable to be able to use the interior of the garage as a patio or the like and the ability of insects, leaves, etc. to enter the interior thereof is troublesome. Further, it is sometimes desirable to leave the garage door partially open such as when it is desired to ventilate the garage during periods when pets are housed therein. Even with the garage door partially open, leaves and insects find their way into the interior of the garage.

It is therefore a principal object of the invention to provide a flexible screen which may be readily extended across a car garage opening.

Still another object of the invention is to provide a screen for a garage door which is readily mounted therein and which has a double zipper provided therein to provide entry into the garage or to provide an exit therefrom.

Still another object of the invention is to provide a screen for a garage door which does not detract from the appearance of the garage when the screen is not being used.

Still another object of the invention is to provide a screen for a garage door which is durable in use, refined in appearance and economical of manufacture.

These and other objects of the present invention will be apparent to those skilled in the art.

SUMMARY OF THE INVENTION

Figure 1:
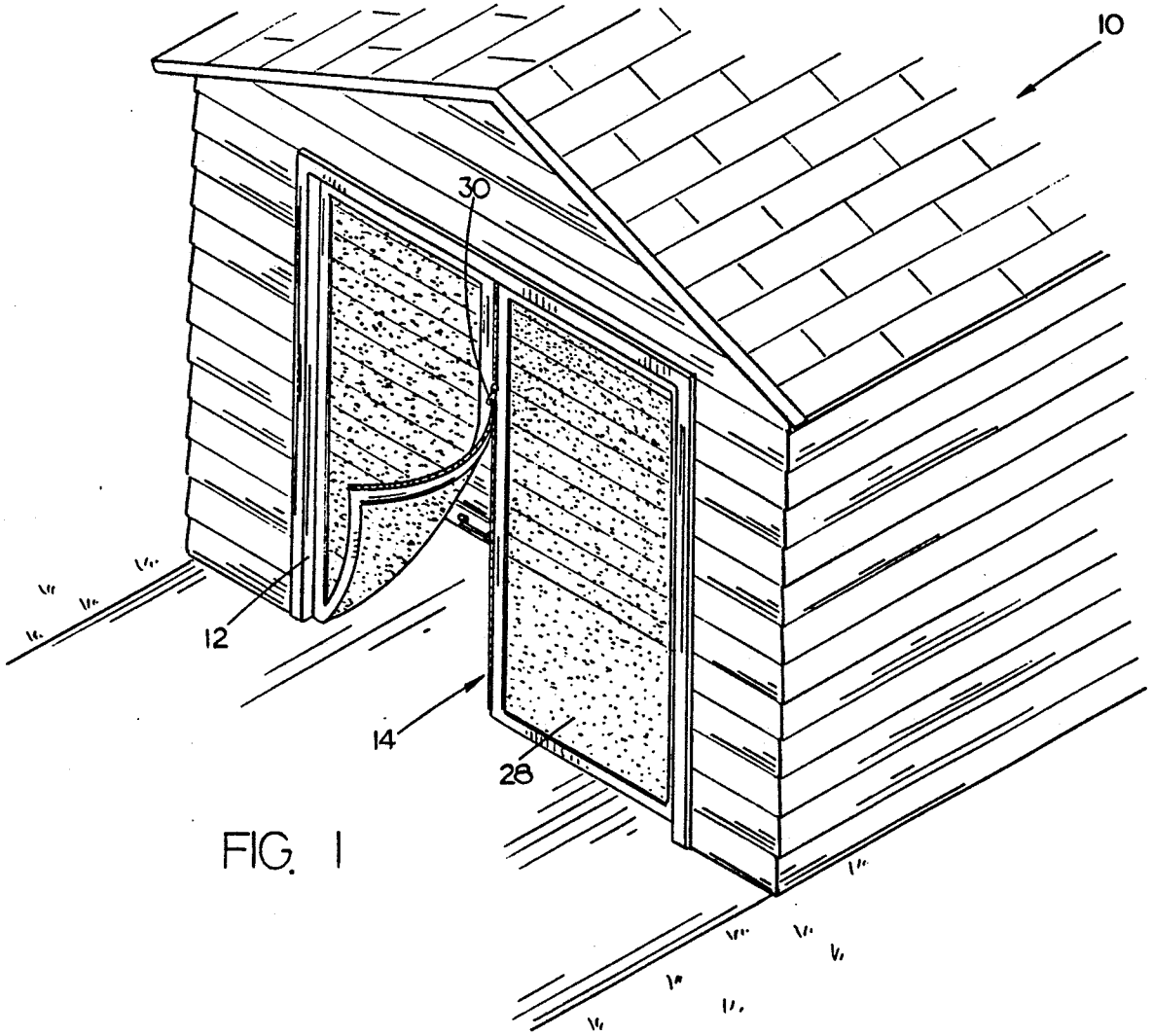
FIG. 1 is a front perspective view of a garage having the removable screen of this invention mounted therein.
Figure 2:
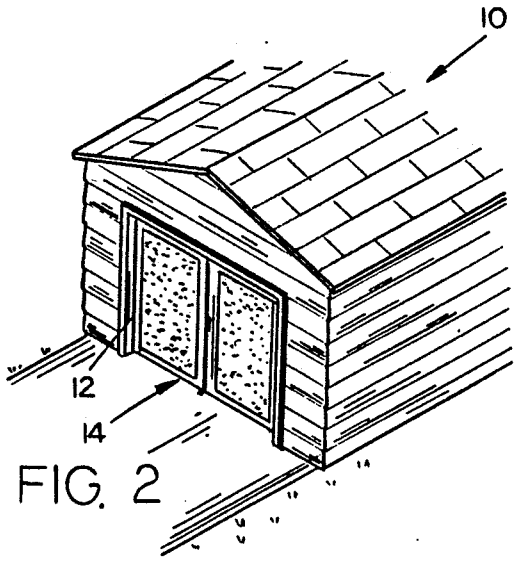
FIG. 2 is a perspective view similar to FIG. 1 except that the screen is in its zipped condition.
Figure 3:
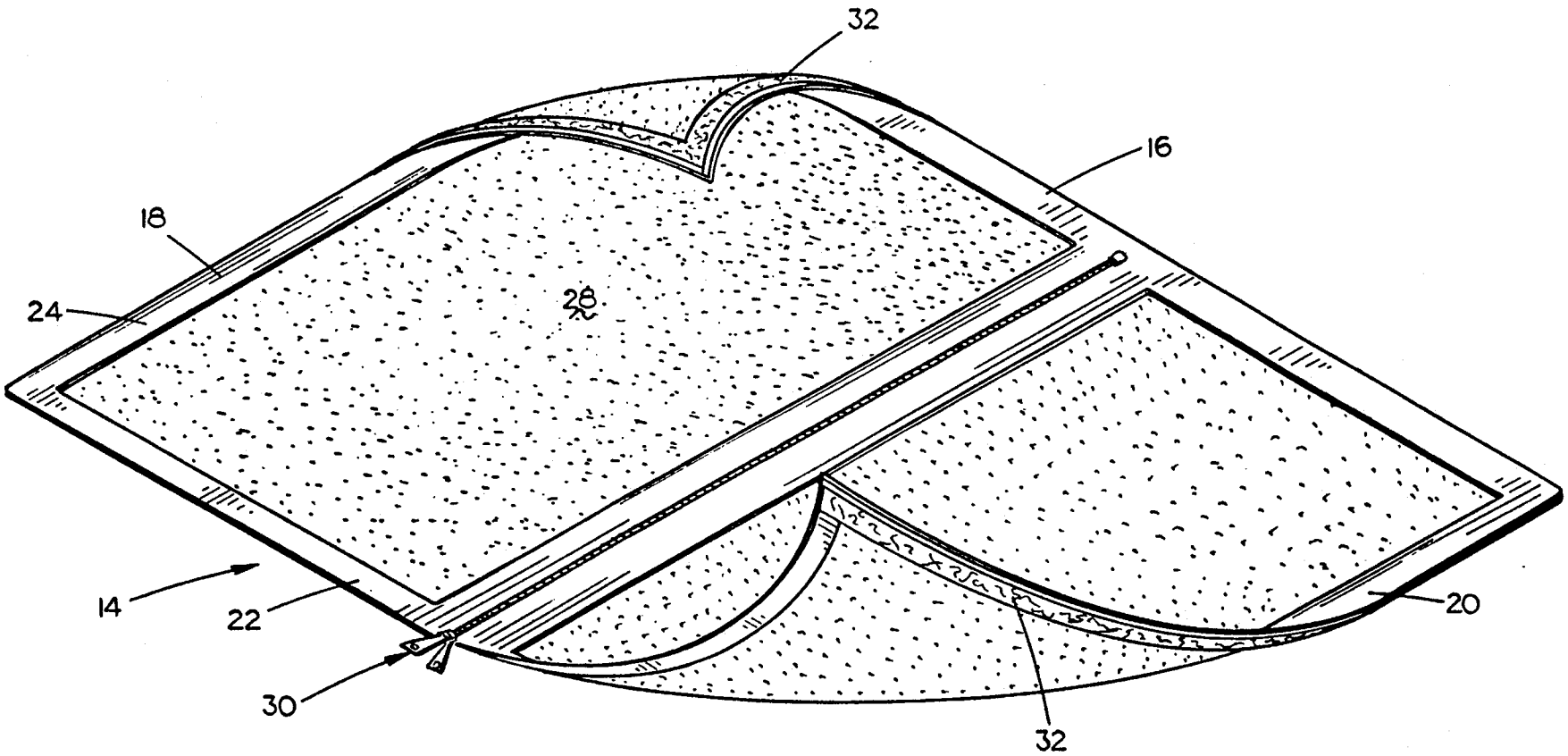
FIG. 3 is a rear perspective view of the screen of this invention with a pair of the corners rolled back to illustrate the Velcro® fastening system secured thereto.

A flat, flexible screen is provided having a top edge, opposite side edges and a bottom edge. A vertically disposed, double zipper is provided in the screen to permit easy access into the garage or to provide an exit therefrom. The hook portion of a Velcro® fastener system is secured to the front side of the screen along the opposite side edges and the top edge thereof. The loop portion of a Velcro® fastening system is secured to the garage door casing around the garage door opening. The screen is quickly and easily extended across the garage door opening by interconnecting the Velcro® fastening elements.

DESCRIPTION OF THE PREFERRED EMBODIMENT

The numeral 10 refers to a conventional garage having a garage door opening 12 formed therein. The flexible screen of this invention is referred to generally by the reference numeral 14 and includes a top edge 16, opposite side edges 18 and 20, and bottom edge 22. Preferably, the edges of the screen are provided with a border 24 extending therearound for durability purposes. For purposes of description, the screen 14 will be described as having a front surface 26 and a back surface 28.

Screen 14 is provided with a vertically disposed double zipper 30 provided therein to permit a person to enter the interior of the garage therethrough or permit a person to exit the garage therefrom.

Figure 4:
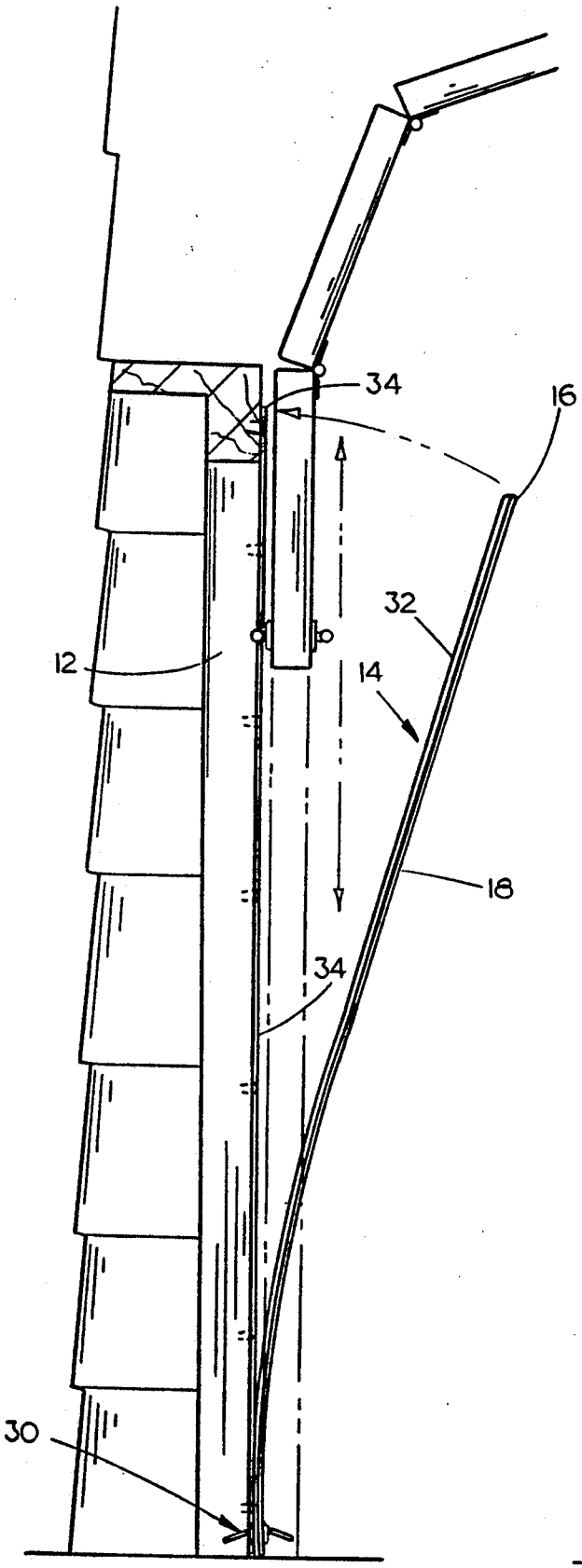
FIG. 4 is a sectional view illustrating the manner in which the screen of this invention is positioned.
Figure 5:
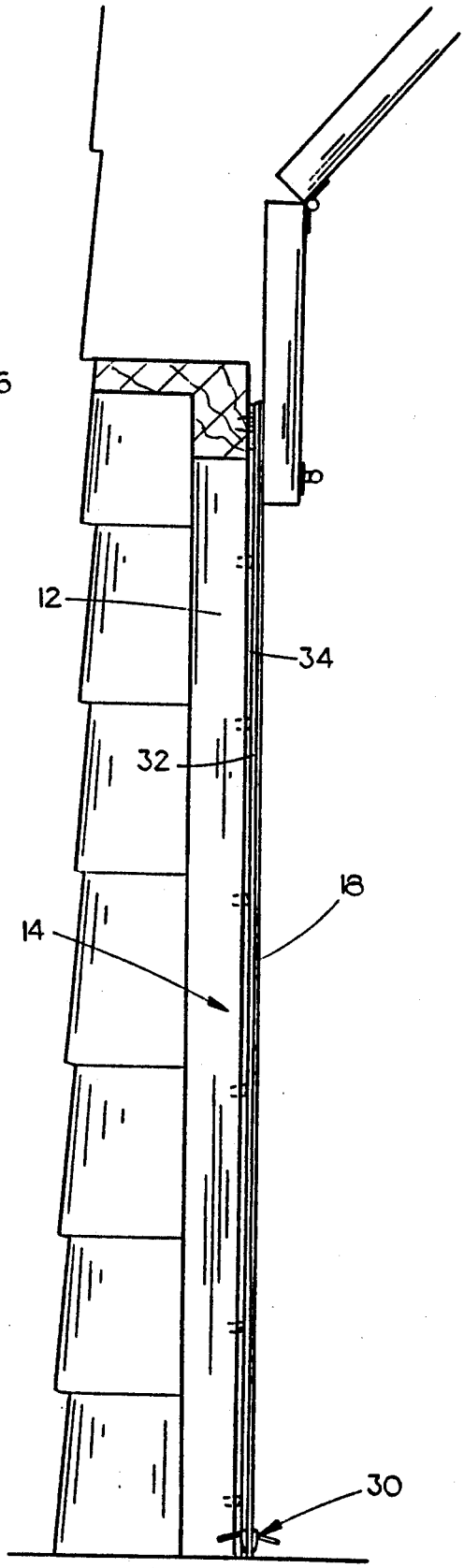
FIG. 5 is a view similar to FIG. 4 except that the screen is in position in the door opening.

Screen 14 is provided with the hook portion 32 of a Velcro fastening system at its front surface along its top edge and side edges. The smooth loop portion of the Velcro® fastening system is referred to generally by the reference numeral 34 and is placed around the interior casing of the door opening so as not to be visible from the exterior of the garage. The loop portion of the Velcro® fastening system normally includes a pressure sensitive adhesive material thereon to enable the material to be adhered to the door casing around the door opening. It is also recommended that the smooth portion 34 be stapled to the door casing along its length to ensure that the loop portion 34 will not become dislodged from the door casing. When it is desired to utilize the screen 14, it is simply necessary to position the screen 14 so that the hook portions 32 at the top and side edges of the screen 14 come into contact with the loop portions 34 of the Velcro® fastening system at the inside surface of the door casing. When so positioned, the screen 14 covers the opening 12. The screen of this invention may be used whether the garage door is fully opened, partially opened or fully closed. When the screen is in place, it prevents insects, leaves, etc. from entering the interior of the garage. Further, the screen permits the interior of the garage to be ventilated if pets or the like are kept in the interior of the garage. In addition, the garage door may be fully closed without having to remove the screen from the door casing. As shown in broken lines in FIG. 4, the garage door is in abutting sealed contact with the screen continuously along the interior casing when in the closed position.

Thus it can be seen that a novel screen has been provided for use in a garage door opening which is quickly and easily installed and quickly and easily taken down. The screen of this invention will have the same size as the garage door mounted in the opening whether that garage door be a single width, double width, etc.

The screen, by being flexible, is conveniently folded for storage when the screen is not being utilized to cover the door opening. Thus it can be seen that the invention accomplishes at least all of its stated objectives.

I claim:

1. In combination, a garage having a door opening formed therein which is selectively closed by a garage door, said garage having an interior casing extending around the upper and side portions of the door opening, a flexible screen means for selectively covering said door opening of said garage, an operable garage door operably mounted in the interior of said garage for movement between a closed position completely covering said door opening, and an open position retracted interiorly away from the door opening, said interior casing having a rearward surface facing the interior of said garage, said garage door having a forward surface facing outward from the interior of said garage when in the closed position, said forward surface of said garage door being located in abutting sealed contact with said screen means continuously along the interior casing when in the closed position, said screen means comprising:

a flat, flexible quadrilateral screen member having a top edge, opposite side edges, and a bottom edge, said screen member having front and rear surfaces, one-half of a hook and loop fastener means secured to the front surface of said screen member extending continuously along the top and side edges of said screen member for removable connection to the other half of a hook and loop fastener means secured to the rearward surface of interior casing around said garage door opening, a vertically disposed zipper means mounted in said screen member approximately midway between said opposite side edges for easy entry or exit through said screen member, said zipper means comprising a double zipper whereby the zipper means may be actuated from within said garage or outside said garage, said screen member removably mounted on the interior casing around said door opening in such a fashion so that said garage door may be positioned in an open position, a partially open position and a closed position inwardly of the screen member, the hook and loop fastener means being positioned on the interior casing so as not to be visible from outside the garage.

* * * * *